US005108294A

United States Patent [19]

Marsh et al.

[11] Patent Number: 5,108,294

[45] Date of Patent: Apr. 28, 1992

[54] TERMINATOR CONNECTOR

[75] Inventors: Edward K. Marsh; Keith H. Dormer, both of Kernersville, N.C.

[73] Assignee: AMP Incorporated, Harrisburg, Pa.

[21] Appl. No.: 700,081

[22] Filed: May 3, 1991

Related U.S. Application Data

[63] Continuation of Ser. No. 558,025, Jul. 25, 1990, abandoned.

[51] Int. Cl.[5] ..... H01R 25/00

[52] U.S. Cl. ..... 439/76; 439/636; 439/607

[58] Field of Search ..... 439/76, 636, 607, 609, 439/610, 660, 638, 65

[56] References Cited

U.S. PATENT DOCUMENTS

| | | | |
|---|---|---|---|
| 3,568,136 | 3/1971 | Wells | 439/638 |
| 3,740,698 | 6/1973 | Jerominek | 439/638 X |
| 4,401,351 | 8/1983 | Record | 439/65 X |
| 4,592,612 | 6/1986 | Kikuta | 439/610 |
| 4,786,257 | 11/1988 | Tengler | 439/76 |
| 4,790,762 | 12/1988 | Harms et al. | 439/65 X |
| 4,934,941 | 6/1990 | Okada | 439/76 X |
| 4,981,438 | 1/1991 | Bekhiet | 439/76 |

OTHER PUBLICATIONS

Photos 1-4 of Data Module for Texas Instrument Model T1-994A Computer.

Photo 1 (Exhibit 1) of prior art connector.

Photo 2 (Exhibit 2) of prior art connector.

*Primary Examiner*—Larry I. Schwartz

*Assistant Examiner*—Julie R. Daulton

[57] ABSTRACT

An electrical termination connector includes a substrate mounted to an insulating housing where the substrate includes conductive paths at a front edge of the substrate interconnected to electrical traces deposited on an upper and lower surface of the substrate. The electrical traces are electrically interconnected to electronic passive devices such as resistors and capacitors to simulate an impedance load to a mateable electrical connector. The assembled substrate and housing are shielded by a front shield member having a shroud surrounding the conductive paths and by upper and lower clam shell shield members which are latched in place to the front shield member. An outer insulating housing is overmolded over the assembled shielded connector to encapsulate the upper and lower shield within the outer insulating housing. As assembled, the electrical termination connector is mateable with a complementary shielded electrical connector in a local area network to simulate the impedance of a peripheral device when the peripheral device is disconnected from the local area network. In this manner, reflection of the data signals back of the network line are prevented.

16 Claims, 8 Drawing Sheets

98
100
102
94
92
96
10
90
104

TERMINATOR CONNECTOR

This application is a continuation of application Ser. No. 07/558,025 filed Jul. 25, 1990, now abandoned.

BACKGROUND OF THE INVENTION

1. Field of the Invention

The subject invention relates to a termination connector for electrical connection to a disconnected connector in a network thereby preventing reflection of the data signals back up the network line.

2. Description of the Prior Art

It is common to provide for data distribution networks where a plurality of electrical connectors are situated in various locations. For example, office buildings typically include electrical connection outlets in each of the offices for electrical connection to a local area network. Such networks typically comprise electrical data cable circulating throughout the office building and interconnected to a host computer. By way of example, such networks are useful for interconnecting a plurality of computer terminals to the common host computer, or can interconnect a plurality of stand alone computers to such peripheral devices as hardcopy printers.

In such networks, the peripheral equipment or printing equipment connected to the electrical connectors throughout the network present impedance loads across the connectors. Such impedance loads are either subject to an industry standard or are designated by manufacturers of the peripheral equipment. In the event that one of the connectors in the network is disconnected, the lack of the impedance across the electrical connector changes the total impedance of the system and can cause a reflection of the data signals in the network cable back up the line, disrupting the data distribution in the network. In such cases, termination connectors are presently available for interconnection to the disconnected connector in the network, simulating the impedance load of the peripheral equipment and thereby preventing any reflection of the data signals back up the network line.

One presently available electrical termination connector is in the form of assignee's CHAMP TM connector where the connector includes stamped and formed electrical contacts positioned in the electrical connector having spring contact portions at a front mating side and electrical lead portions extending from a rearward side. The electrical lead sections of the terminals are soldered to electrical traces on a substrate. The electrical traces on the substrate are thereafter interconnected to a resistive network whereby the impedance of the resistive network simulates the impedance load of the peripheral equipment typically interconnected to the network connector thereby preserving the impedance balance throughout the network.

One of the disadvantages of the present termination connector is that the connector is quite labor intensive. As mentioned above, the termination connector includes a plurality of stamped and formed contacts having lead sections extending from the rearward side. As this electrical connector is of the type having two opposed rows of electrical contacts, the lead sections extending from the rearward side are presented in a closely spaced array of opposed contacts. The substrate must thereafter be placed intermediate the two opposed rows of contact leads and must be soldered to individual pads on the substrate. Due to the fragility of the lead sections extending from the rearward side, it is possible to have misalignment problems between the contact lead sections and the conductive pads on the substrate. The presently available termination connector is further complicated by having to solder the substrate to the resistive network. With the many levels of interconnection, the presently available termination connector is subject to a faulty connection or a disconnection. Moreover, with this many levels of interconnections, it is difficult to maintain the overall impedance at a constant value.

It is an object of the invention then to provide an electrical termination connector, having simplified fabrication procedures.

It is a further object of the invention to provide an electrical termination connector whereby the impedance of the resistive network can be precisely held to a constant impedance value.

Other objects and advantages of the invention will be apparent from the following description, the accompanying drawings and the appended claims.

SUMMARY OF THE INVENTION

The above-mentioned objects are accomplished by providing an electrical connector for the electrical mateability with a shielded electrical connector where the shielded electrical connector has two rows of opposed contacts. The electrical terminator connector comprises electrical substrate means having electrical conductor means disposed thereon, where the conductor means comprises conductive pads arranged along a front edge of the substrate means and adapted for receipt between and in electrical engagement with, the two rows of opposed contacts. The conductor means further comprise electrical traces extending from the conductive pads which are electrically connected to a plurality of passive components, where the components are adapted to collectively represent an impedance load across the conductor means. The electrical termination connector further comprises electrical shielding means at least partially enclosing said substrate means and includes a front mating shroud profiled for mateable shielded engagement with a complementary shielded shroud on the mateable shielded electrical connector.

By providing an electrical substrate means having conductive pads thereon interconnected to the plurality of passive components, the electrical substrate means is directly interconnectable to the contacts of the shielded electrical connector in the network. This direct interconnection removes two levels of interconnection previously found on prior art connectors. More particularly, the present inventive connector does not require lead sections extending outwardly from the rearward side of the electrical connector, and soldered to electrical traces on a substrate. Nor does the inventive electrical connector require a soldered interconnection between the substrate and the resistive network. Rather, the conductive pads on the substrate are directly interconnected to the contacts in the network connector, and the electrical traces which are continuous with the conductive pads, are directly connected to the passive components.

BRIEF DESCRIPTION OF THE DRAWINGS

FIG. 3 is a front view of the subject connector.

FIG. 5 is a front plan view of the housing of the subject invention.

FIG. 9 is a bottom plan view of the upper shield member.

FIG. 13 is a front plan view of the front shielding member of the subject invention.

FIG. 14 is a cross-sectional view through lines 14—14 of FIG. 13.

DETAILED DESCRIPTION OF THE PREFERRED EMBODIMENT

Figure 1:
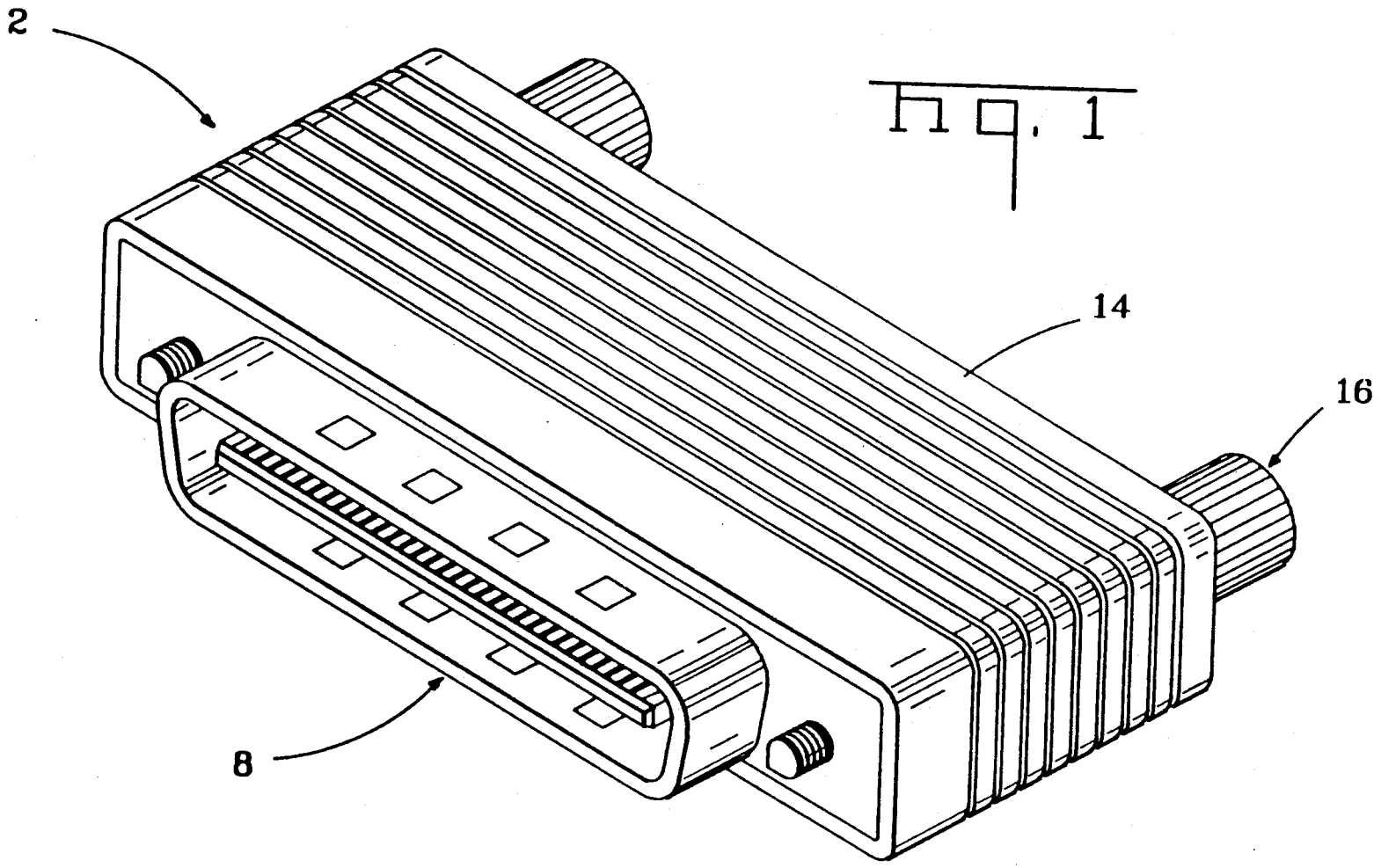
FIG. 1 is an isometric view of the subject invention.
Figure 4:
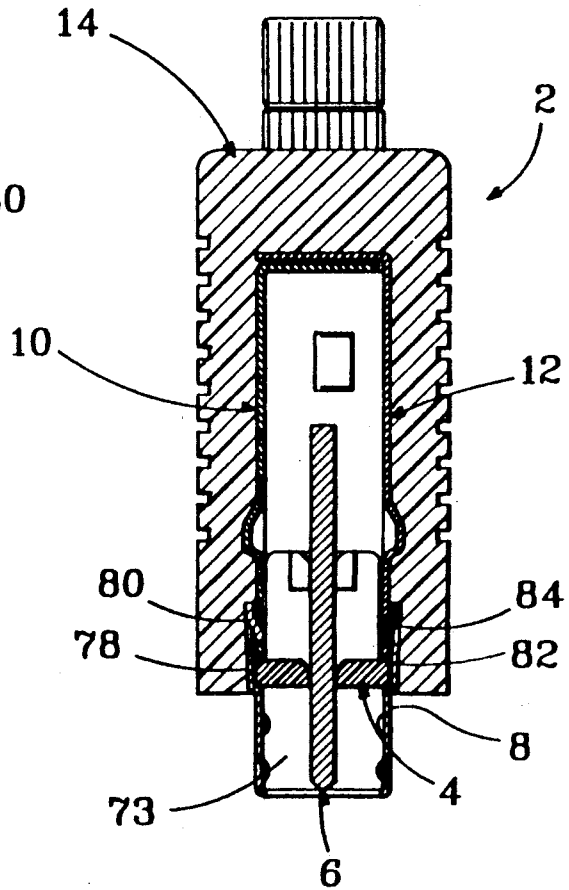
FIG. 4 is a cross-sectional view through lines 4—4 of FIG. 2.
Figure 2:
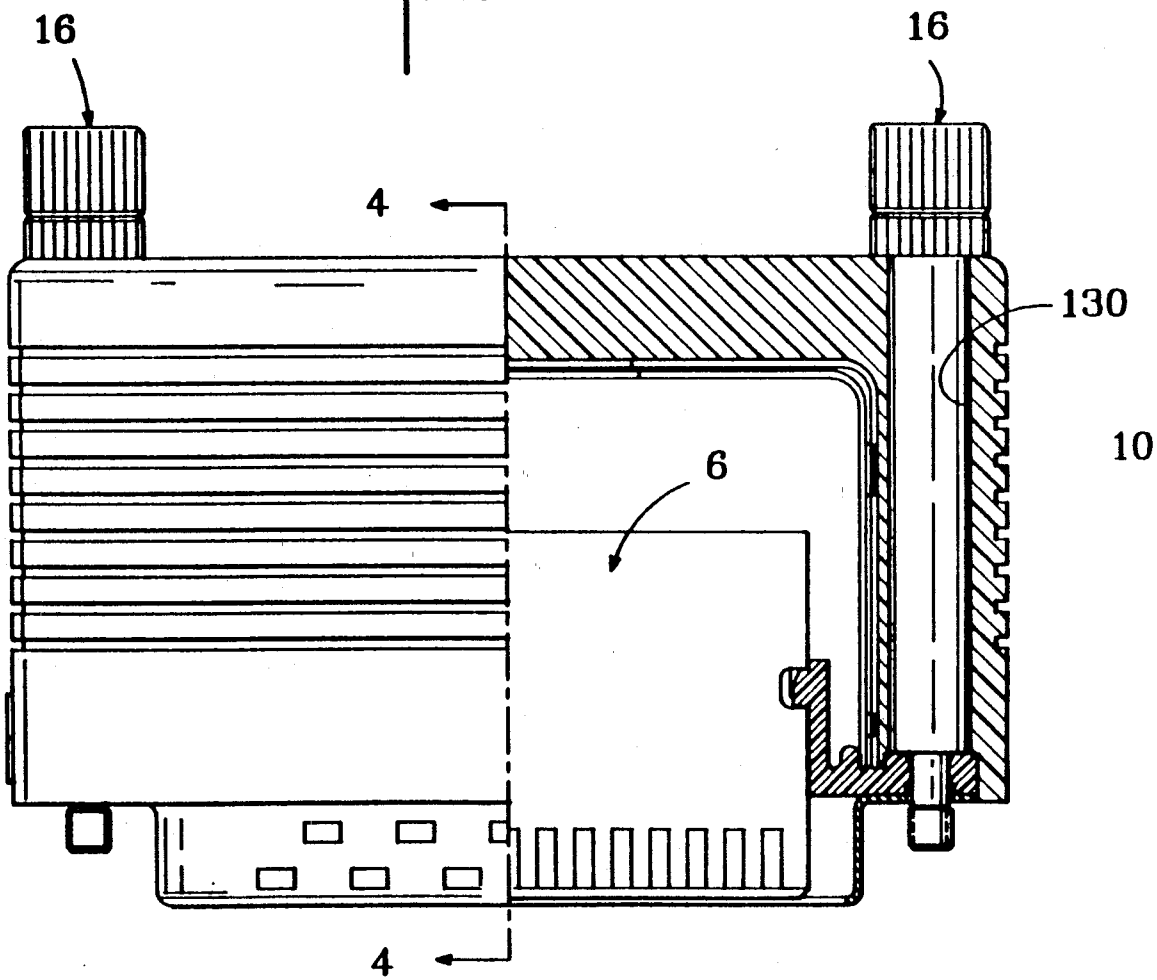
FIG. 2 is a top plan view of the subject invention, partially broken away to show the inner structure.
Figure 1:
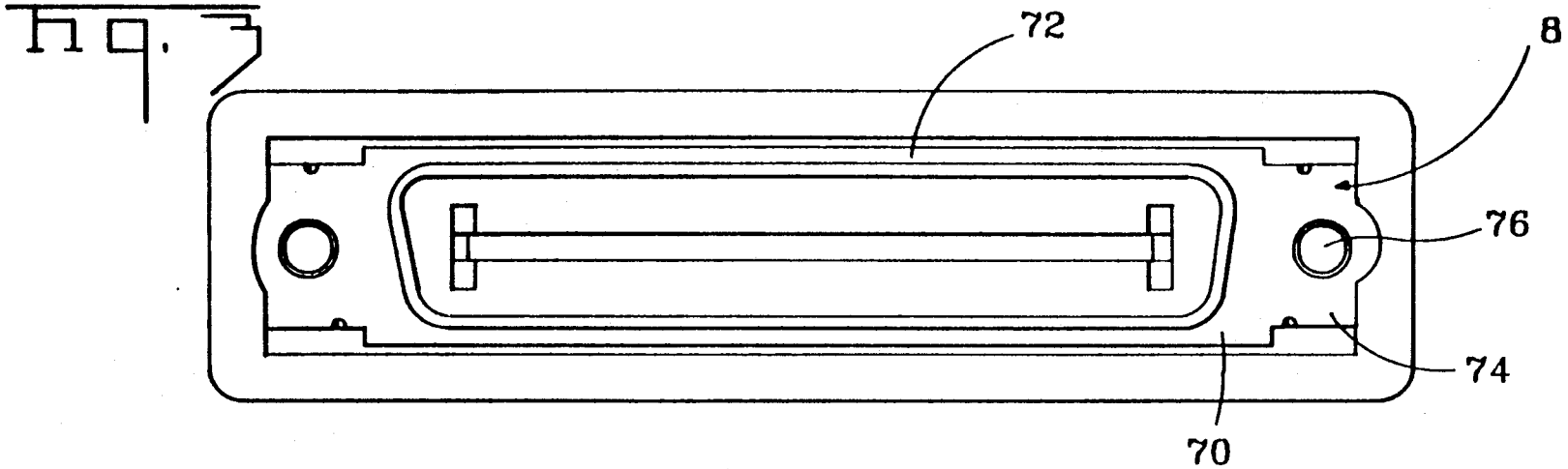

With reference first to FIGS. 1 and 4, the subject termination connector is shown generally at 2 comprising an insulating housing 4 having a substrate 6 connected to the housing 4. A front shield member 8 is electrically grounded to an upper shielding shell 10 and lower shielding shell 12; and cooperate to substantially surround the insulating housing 4 and the substrate 6. The assembly is overmolded, for example at 14, to provide an outer insulating housing. Thumbscrews, such as 16, are provided through the overmolded housing 14 to draw the connector 2 into mating connection with a complementary connector.

Figure 6:
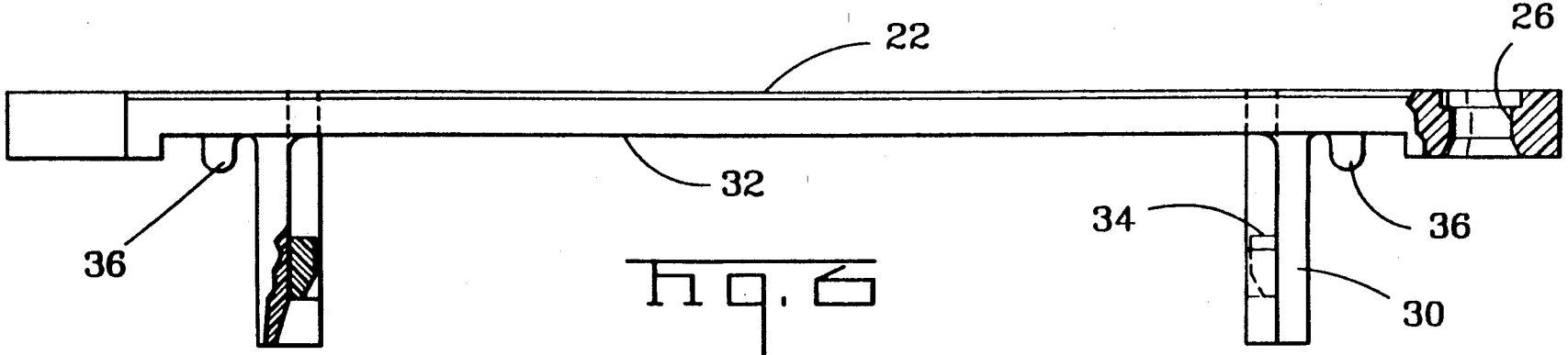
FIG. 6 is a top plan view of the housing of FIG. 5.
Figure 7:
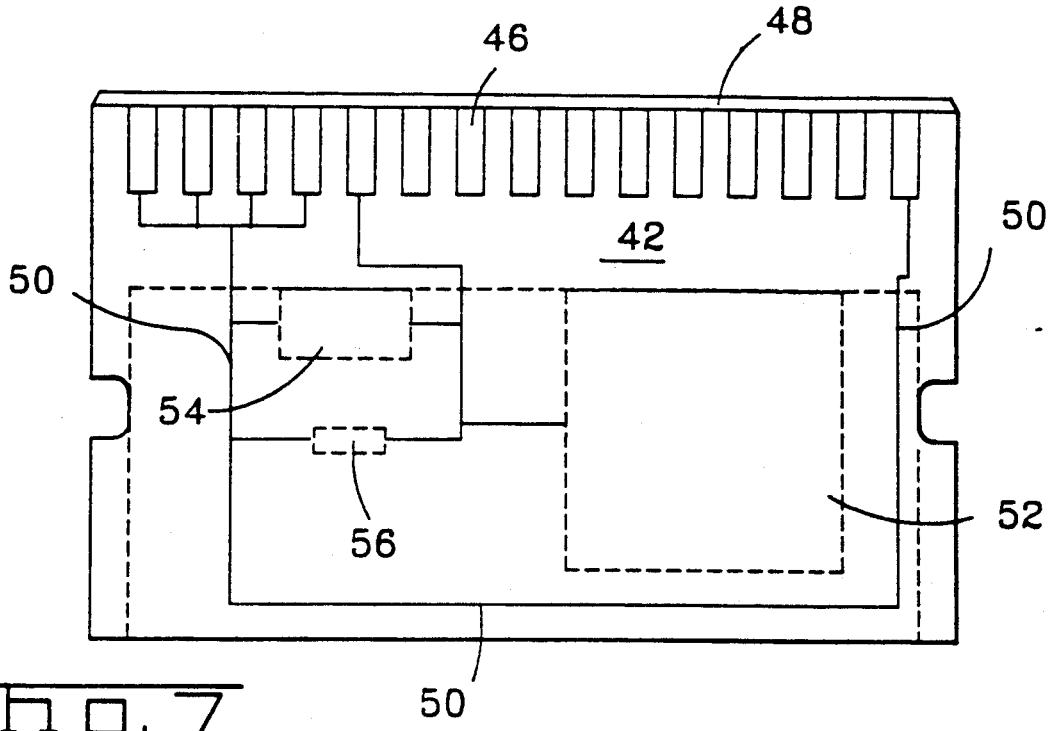

With reference now to FIGS. 5 and 6, the insulating housing 4 is shown in greater detail. The insulating housing 4 includes a front wall 20 having a front mating face 22, with mounting flanges 24 at opposite ends of the front wall 20, each flange having a mounting through hole 26 extending through the flange 24. The front wall 20 also includes a slot 28 extending through the front wall 20. As shown in FIG. 6, two retention arms 30 extend from the rear face 32 and flank the slot 28, and include forwardly facing latching shoulders 34. The housing also includes locating lugs 36 extending from the rear face 32 where each locating lug 36 is outside of the retention arms 30.

Figure 7:
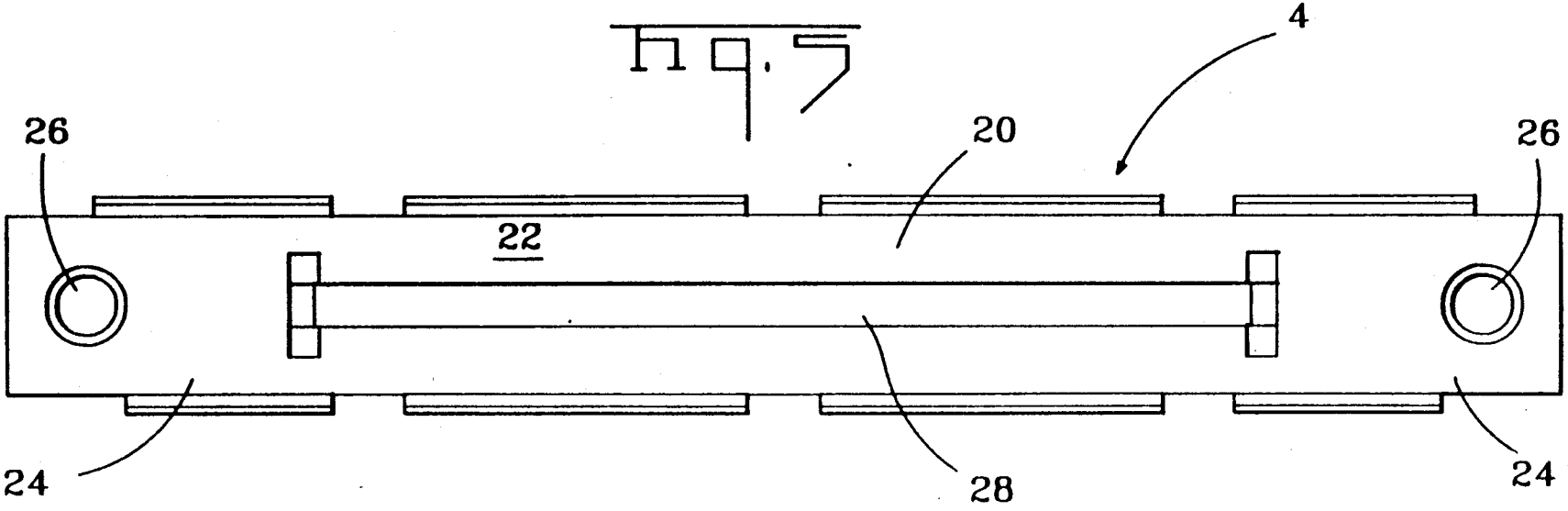
FIG. 7 is a top plan view of the substrate used with the subject connector.
Figure 8:
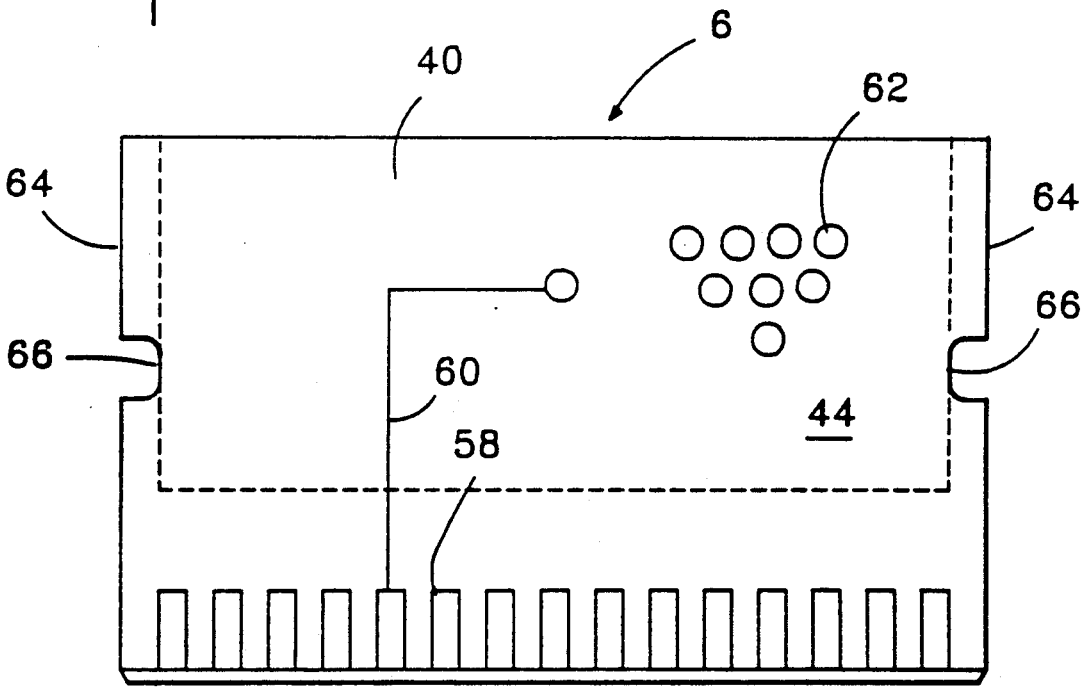
FIG. 8 is a bottom plan view of the substrate of FIG. 7.

With reference now to FIGS. 7 and 8, the substrate 6 generally comprises a printed circuit board 40 having an upper surface 42 and a lower surface 44. The printed circuit board 40 further comprises a plurality of conductive pads 46 adjacent to a front edge 48 of the printed circuit board 40. The conductive pads 46 are in electrical continuity with a plurality of electrical printed traces, such as 50, deposited, or otherwise formed, on the upper surface 42 of the printed circuit board 40. The electrical circuit traces 50 are interconnected to passive devices, such as resistors 52 and capacitors 54 and 56. Conductive pads 58 are also deposited on the lower surface 44 of the printed circuit board 40 and are electrically connected to electrical printed traces 60 on the lower surface 44 of the printed circuit board 40. Selected traces 60 are interconnected to various other traces 50 on the opposite side of the printed circuit board 40 through soldered vias 62. The printed circuit board 40 further includes side edges 64 having notches or recesses 66 therein.

With reference now to FIGS. 13 and 14, the front shield member 8 generally includes a plate section 70 having a shroud 72 extending forwardly from the front plate section 70. The front plate 70 further includes flange sections 74 extending from the ends of the plate member 70 having through holes 76 profiled to align with the through holes 26 in the housing member 4. The front shield member 8 further includes upper and lower flap sections 78 and 82, extending continuously from the plate member 70 and having stamped out latches 80 and 84, respectively.

Figures 7, 10:
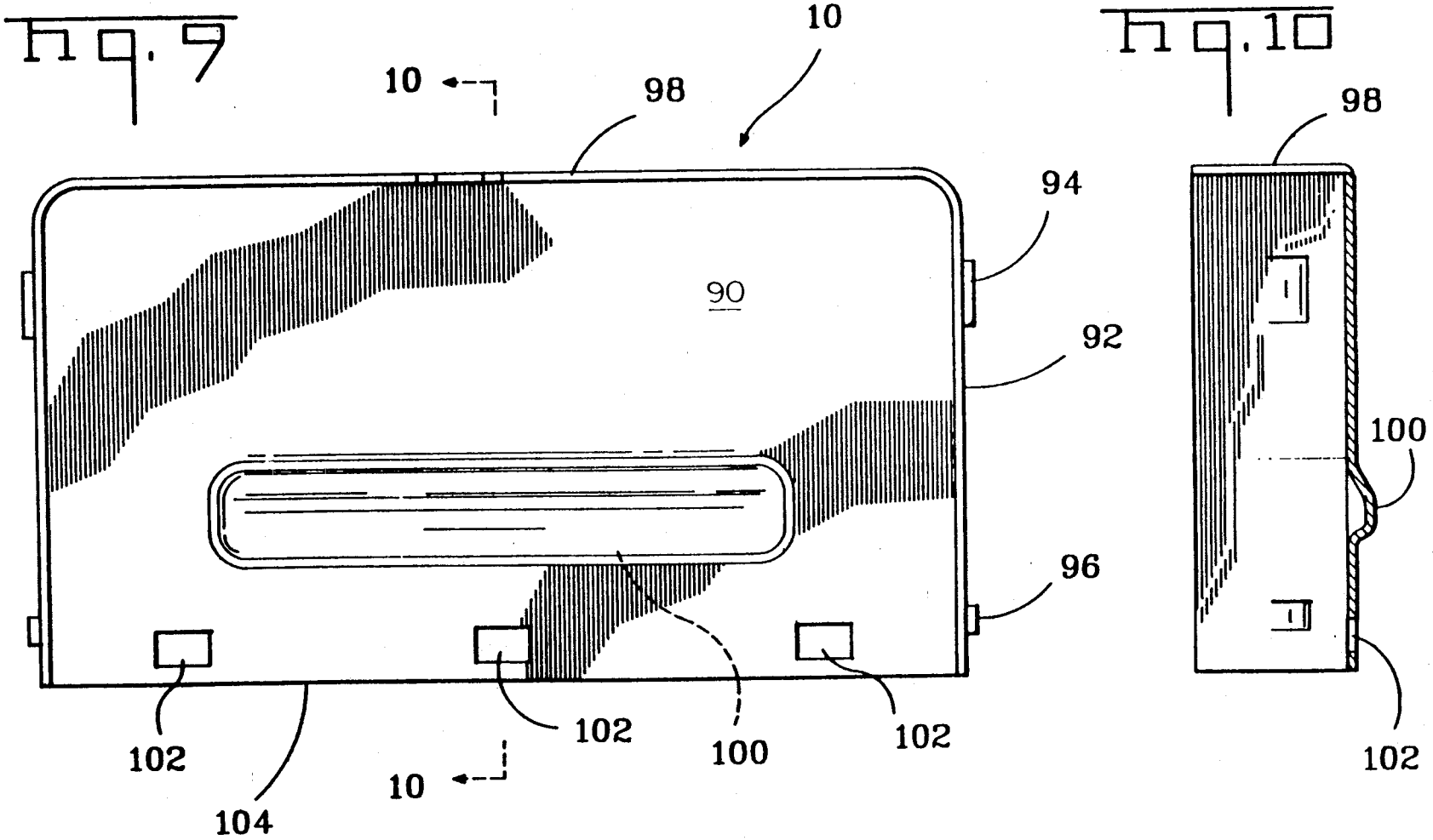
FIG. 10 is a cross-sectional view through lines 10—10 of FIG. 9.
Figures 11, 12:
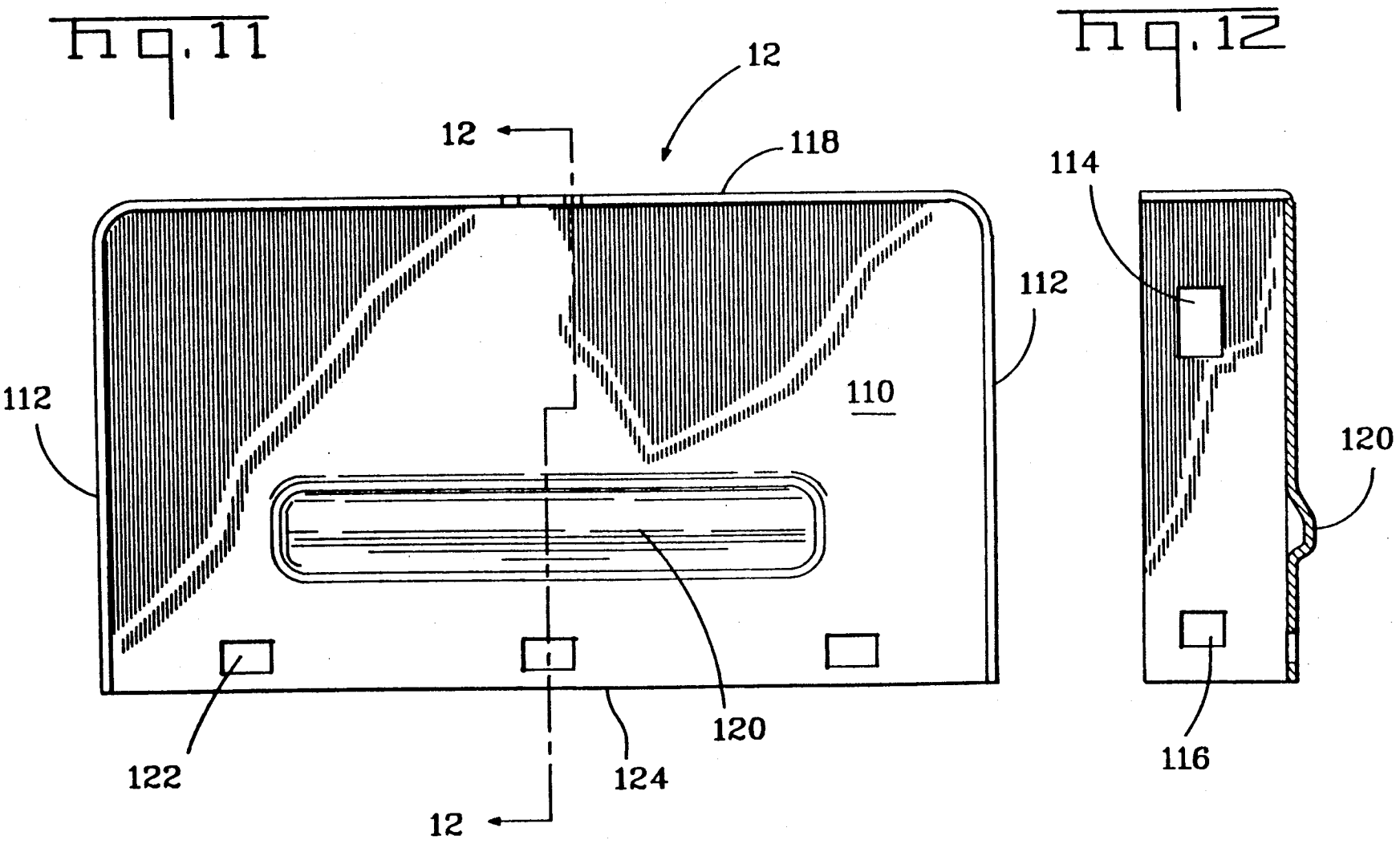

With reference now to FIGS. 9 and 10, the inner shield 10 includes a plate section 90 having side walls 92 extending upwardly therefrom, where each of the side walls 92 include stamped out latch members 94 and 96. The inner shield member 10 further includes a rear wall 98 integral with the plate section 90 and with the side walls 92. Finally, the plate section 90 includes an outwardly projecting rib 100 and a plurality of windows 102 adjacent to a front edge 104 of the plate member 90.

Figure 12:
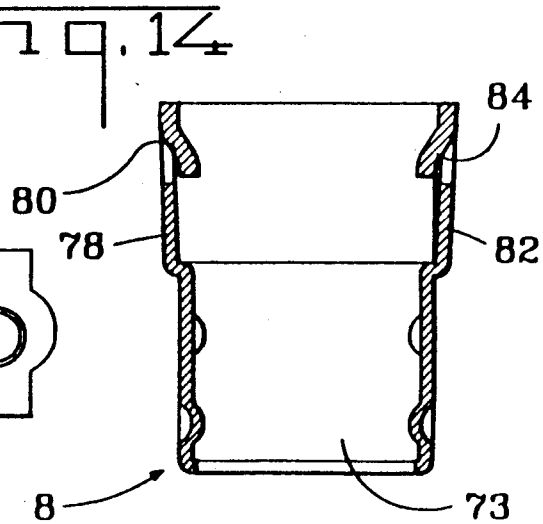
FIG. 12 is a cross-sectional view through lines 12—12 of FIG. 11.
Figure 11:
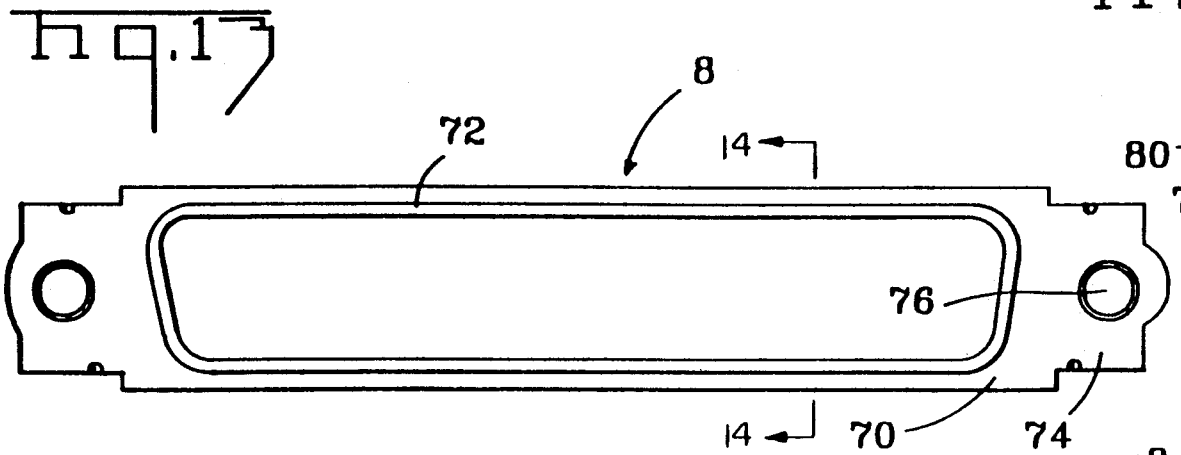
FIG. 11 is a bottom plan view of the lower shield member.

With reference now to FIGS. 11 and 12, the lower and outer shielding shell 12 comprises a plate section 110 having side walls 112 extending upwardly therefrom. Each side wall 112 includes stamped out windows 114 and 116, where the windows 114 and 116 are adapted to receive the latch members 94 and 96 of shielding shell 10, as more fully described herein. The outer shielding member 12 further includes a rear wall 118 also integral with side walls 112 and plate 110. Finally, the plate member 110 comprises an outwardly extending rib 120 and a plurality of windows 102 adjacent to a front edge 124 of the plate section 110.

To assemble the subject connector, the substrate 6 is inserted through the slot 28 of the insulative housing 4 through the rear face 32 thereof which positions the conductive pads 46 and 58 of the substrate 6 adjacent to, but beyond the front mating face 22 of the housing 4. The substrate 6 is inserted into the housing 4 to a position where the recesses 66 of the subject 6 latch into engagement with the latching shoulders 34 on the resilient arms 30 of the housing 4. The front shielding member is now insertable over the housing such that the through holes 76 in the shield member 8 align with the through holes 26 in the housing member 4. It should be noted that this places the shroud member 72 of the front shield member 8 in a surrounding, but non-contacting, relationship with the conductive pads 46 and 58 on the substrate 6.

Inner and outer shield members 10 and 12, are of the clam shell type and the lower shield member 12 overlaps the upper shield member 10 to a position where the windows 114 and 116 of the lower shield member 12 overlap and engage the latches 94 and 96 of the upper shield member 10. The assembled upper and lower shield members 10, 12 are now slidable over the housing 4 and the substrate 6, such that the front edge 104 of the upper shield member 10 and the front edge 124 of the lower shield member 12 are positioned below the upper and lower flaps 78, 82, respectively, and are latched in place thereto, with the windows 102, 122 in engagement with the latches 80 and 84 on the upper and lower flaps, respectively. It should be noted that as assembled, the forward shield member 8 and the upper and lower shield members 10 and 12 effect a totally surrounding shield for the housing and the substrate, save for the opening 73 provided through the shroud 72 of the forward shield member 8.

To complete the assembly, an outer insulating housing 14 is overmolded over the upper and lower shield members 10, 12 to encapsulate them therein. To this end, the projecting ribs 100 and 120 are provided on the upper and lower shield members 10 and 12 to prevent axial movement of the outer overmolded housing 14. The outer insulating housing 14 has also been molded over the upper and lower shielded members 10, 12 to insulate the shielded members 8, 10 and 12, and to encapsulate the discrete items into a unitary assembly. The outer housing is molded so as to provide through holes 130 in alignment with both of the through holes 26 and 76 for the receipt of a thumb screw 16 through the completed assembly providing for threadable mateability with a mateable electrical connector.

Figure 15:
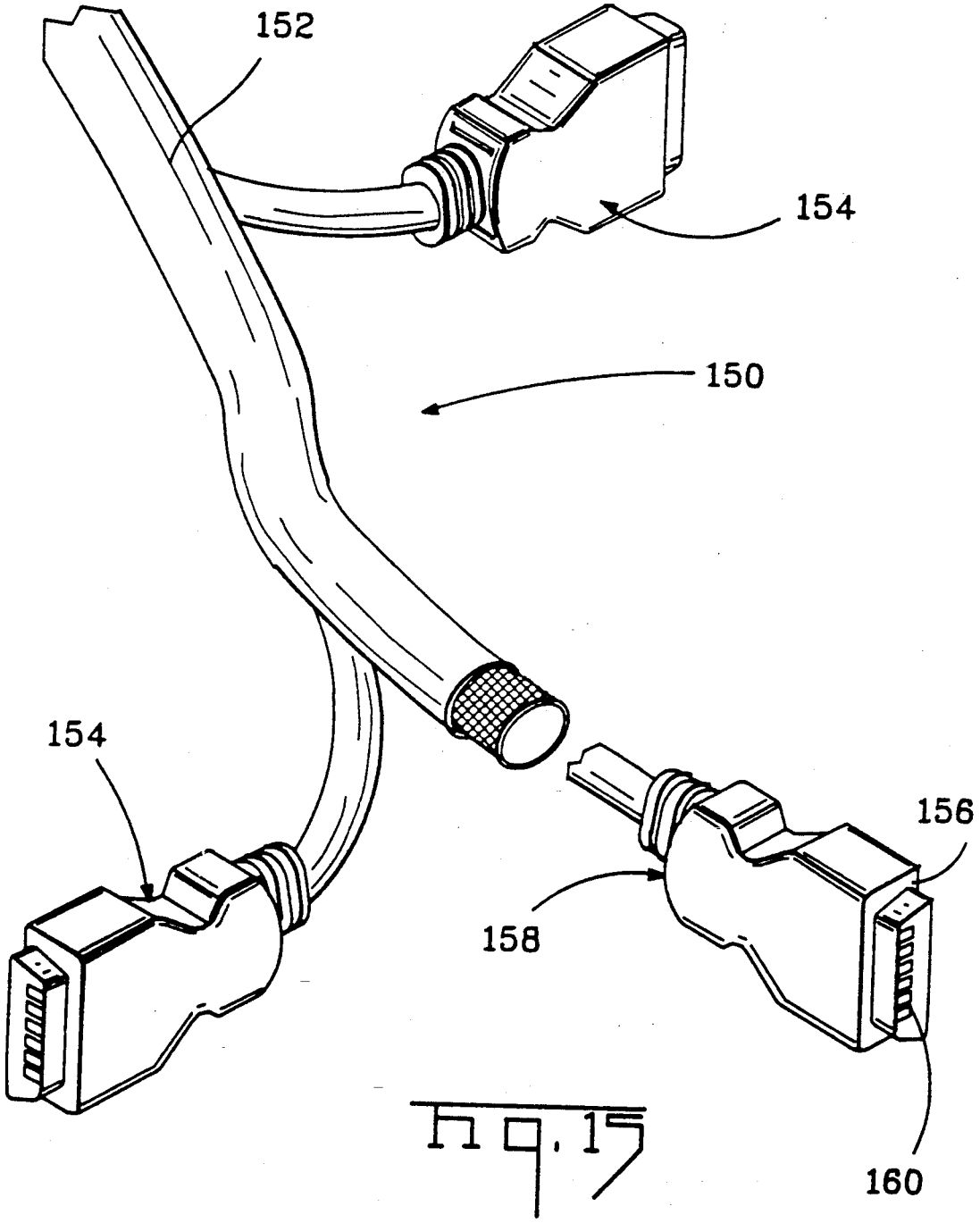
FIG. 15 is a diagrammatical view showing a network having a plurality of electrical connectors interconnected to a shielded cable.

With reference now to FIG. 15, the termination connector 2 as described above is used with a network 150 where a plurality of data connectors 154 are interconnected to shield the data cable 152. The data connectors 154 are of the type describe in patent application Ser. No. 07/431,049, filed on Nov. 1, 1986, incorporated herein by reference. The shielded data connectors 154 are receptacle connectors having front mating faces 156 and rear wire connecting faces 158. The data connectors 154 include a plurality of electrical terminals 160 disposed in two parallel and opposed rows. It should be understood that the data cable 152 is circulated throughout the building or office with one data connector 154 interconnected to each of the computer terminals in the network. If any of the connectors 154 are disconnected, a termination connector 2, as described above, is connectable with the data connectors 154 to simulate the impedance of the peripheral equipment. In this manner, reflection of the data signals back of the line, due to mismatched impedance, is prevented.

While the form of apparatus herein described constitute a preferred embodiment of this invention, it is to be understood that the invention is not limited to this precise form of apparatus, and that changes may be made therein without departing from the scope of the invention which is defined in the appended claims.

What is claimed is:

1. An electrical connector for the electrical mateability with a network electrical connector having two rows of opposed contacts therein, the connector comprising:

electrical substrate means including a printed circuit board having electrical conductor means disposed thereon, said conductor means comprising circuit pads arranged along a front edge of said substrate means and being adapted for receipt between, and in electrical engagement with, the two rows of opposed contacts, said conductor means further comprising electrical traces extending from said circuit pads and being electrically connected to a plurality of passive components mounted to said substrate means, said components adapted to collectively represent an impedance load across said conductor means; and an insulative housing means comprising a slot extending through said housing means, said slot being adapted to receive said substrate means therethrough, said insulative housing means further comprising, a front mating face, and mounting means for mounting said substrate means to said housing means with said circuit pads projecting outwardly from said mating face, said mounting means comprise retention arms extending rearwardly from said mating face, flanking said slot, and said retention arms having latching shoulders adapted to engage recess means in said substrate means.

2. The electrical connector of claim 1, wherein said recess means are in side edges of said substrate means.

3. The electrical connector of claim 1, further comprising shielding means at least partially surrounding said substrate means.

4. The electrical connector of claim 3, wherein said substrate means is positioned within said shielding means, such that said conductive pads are in encircling surroundment by said shroud.

5. The electrical connector of claim 3, wherein said shielding means comprises a front shroud positioned forwardly of said front mating face, and encircling said conductive pads.

6. The electrical connector of claim 5, wherein said shielding means comprises upper and lower shield shells surrounding said housing means, and a forward shielding member carrying said shroud.

7. The electrical connector of claim 6, wherein, the shielding means is at least partially overmolded with an insulative material to define an outer insulating housing.

8. The electrical connector of claim 5, wherein said shielding means totally encloses said housing means and said substrate means, with the exception of an opening in said shroud.

9. The electrical connector of claim 8, wherein the shielding means is at least partially overmolded with an insulative material to define an outer insulating housing.

10. The electrical connector of claim 8, wherein said shielding means comprises a front shielding section, and an upper and a lower shielding shell, wherein one of said shells is in at least partial overlapping engagement with the other said shell, to entrap the housing means therebetween.

11. The electrical connector of claim 10, wherein said upper and lower shielding shell are snap latchable to said front shielding section.

12. A local area network comprising:

a plurality of electrical network connectors positioned in a continuous array, each said connector comprising an insulating housing having a front mating face and a rear wire connecting face, each said connector further comprising at least one row of electrical terminals mounted in said housing with spring contact portions positioned adjacent to said front mating face, where some of said connectors are connected to further electrical devices, and at least one said connector is disconnected; and an electrical terminating connector electrically connected to said one disconnected network connector, said terminating connector comprising a housing means for mounting a substrate means thereto, said substrate means including electrical conductor means disposed thereon, said conductor means comprising conductive pads arranged along a front edge of said substrate means and being adapted for receipt against, and in electrical engagement with, the one said row of opposed contacts, said conductor means further comprising electrical traces extending from said conductor pads and being electrically connected to a plurality of passive components, said components adapted to collectively represent an impedance load across said conductor means, simulating a load from a network device, and thereby preventing reflection through said network.

13. The network of claim 12, wherein said insulating housing of said electrical network connectors comprises a longitudinal channel extending along the mating face, having two rows of opposed contacts positioned in said channel defining a spacing between said opposed contacts.

14. The network of claim 13, wherein said substrate means comprises conductive pads on each side thereof, and said substrate means is profiled for receipt within said spacing, with said conductive pads on each side of said substrate means, in electrical engagement with a respective row of said electrical terminals.

15. The network of claim 12, wherein said terminator connector includes shielding means having a shielding shroud surrounding said conductive pads of said substrate means.

16. The network of claim 15, wherein said electrical connectors further include shielding shrouds surrounding said mating face of said electrical connectors, said electrical connectors being connected to said terminator connector with said substrate means positioned within the longitudinal channel, and the shielding means of said terminator connector in mating engagement over said shielding means of said electrical network connector.

* * * * *